US006230715B1

(12) United States Patent
Cho

(10) Patent No.: US 6,230,715 B1
(45) Date of Patent: May 15, 2001

(54) DEVICE FOR CURLING EYELASHES

(76) Inventor: Yong-Hoon Cho, 604 Murfield Ct., Fullerton, CA (US) 92835

( * ) Notice: Subject to any disclaimer, the term of this patent is extended or adjusted under 35 U.S.C. 154(b) by 0 days.

(21) Appl. No.: 09/432,257

(22) Filed: Nov. 2, 1999

Related U.S. Application Data

(63) Continuation-in-part of application No. 09/250,238, filed on Feb. 16, 1999.

(51) Int. Cl.[7] ..... A45D 40/30; A45D 2/48
(52) U.S. Cl. ..... 132/217; 132/216
(58) Field of Search ..... 132/216, 217, 132/218; 219/222, 223, 225, 227, 482, 490, 494

(56) References Cited

U.S. PATENT DOCUMENTS

| | | | | |
|---|---|---|---|---|
| 1,925,266 | * | 9/1933 | Manning | 132/217 |
| 4,212,311 | | 7/1980 | del Valle . | |
| 5,524,649 | * | 12/1998 | Suh | 132/216 |
| 5,685,324 | * | 11/1997 | Huang | 132/216 |
| 5,853,010 | * | 12/1998 | Suh | 132/217 |

FOREIGN PATENT DOCUMENTS

| | | | | |
|---|---|---|---|---|
| 81 2113 | | 11/1981 | (KR) . | |
| 83 1778 | | 7/1983 | (KR) . | |
| 831178 | * | 7/1983 | (KR) | 132/217 |
| 90 7561 | | 8/1990 | (KR) . | |

* cited by examiner

*Primary Examiner*—John J. Wilson
*Assistant Examiner*—Robyn Kieu Doan

(57) ABSTRACT

A device for curling eyelashes provides an automatic curling of eyelashes by either a sole application of pressure or by a simultaneous application of heat and pressure. The device particularly includes a main body having a handle and a forwardly curved extension part on each side of the main body and sited in an upper part of the handle, the handle portion having optional batteries therein; a forming member installed on the top end of both extension parts, the forming member having an eyelash-line shape and a circular bottom with an opening longitudinally formed therein; a pressurizing member movable up and down installed between extension parts of the main body and having a silicon pad attached to an upper part thereof, the silicon pad conforming closely to the lower part of the forming member; a rising and falling member installed on the main body for raising the pressurizing member; a heating member for heating the eyelash opening part of the forming member; a power switch for controlling the heating member installed on the main body; and an indicating lamp representing the state of power installed on the main body, thereby preventing overheating of the eyelash curler by automatically controlling the heating temperature of the heater to a suitable temperature for curling eyelashes.

20 Claims, 11 Drawing Sheets

DEVICE FOR CURLING EYELASHES

This is a Continuation-In-Part application of Ser. No. 09/250,238, filed Feb. 16, 1999.

BACKGROUND OF THE INVENTION

1. Field of the Invention

This invention relates to a device for curling eyelashes in an upward curl, and more particularly, to a device which is able to create a desired curl or reshaping in less treatment time and of longer duration than conventional eyelash curlers by either the application of pressure alone or by a simultaneous application of pressure and prescribed heat.

2. Description of Related Art

For many years, various devices for use in the curling of eyelashes have been available in order to satisfy the female's desire for enhanced beauty, especially pertaining to the eyes. Some examples include pincer shaped forming devices whose negative results include the undesirable pulling out of lashes during use thereof. Use of a forming liquid is another method for eyelash shaping, and this method often results in stiff, unnatural looking and feeling lashes.

Efforts to overcome the faults of the aforementioned devices resulted in the development of several eyelash curlers such as Korean Utility Model Nos. 81-2113, 83-1178, and 90-7561. Each of these devices uses a battery heated rod, causing the eyelashes to curl upward by slight pressure at the base of the eyelash. Curlers using only the heated rod method of curling lashes suffer from their inability to form the eyelash into a curved shape that follows the contour of the eye since the heated rod can only lift a segment of lashes at a time, requiring repeated applications that may vary in effectiveness according to the proficiency and/or experience of the user. Under these circumstances, a uniform curling angle across all lashes becomes difficult. Additionally, such eyelash curlers using a heat-generating member for increasing a temperature of the device often cannot control the rise in temperature without specially designed controls or interruption of treatment. This results in both an inconvenient and inefficient operation and excessive battery use. Also, the danger of skin or eyelash burn exists and the user is not able to accurately estimate a remaining battery life of the device.

The inconvenient practice of interrupting the operation of the curler in order to sufficiently cool the over-heated heat-generating member will always be present without a method of determining the remaining battery life and will surely cause a more frequent replacement of batteries.

Additionally, conventional eyelash curlers do not have a function to check usable power remaining in the batteries.

Since such conventional eyelash curlers do not have functions to indicate a temperature status of the heater or a battery power status, improper and/or unsafe operations may result.

That is to say, when the power switch is turned "on" to use an eyelash curler, a heater therein starts generating heat and the temperature of the heater should rise to a predetermined temperature prior to use. However, the conventional eyelash curler can not indicate a heated state of the heater so that during operation, the eyelashes fail to form into a well-curved shape or sometimes eyelashes become burned due to over-heating of the heat-generating member.

Further, since conventional eyelash curlers do not have a function to check the state of batteries therein and to indicate a heater temperature status thereof, there is an inconvenient problem such that the power of the eyelash curlers is occasionally automatically turned off during use.

SUMMARY OF THE INVENTION

The herein described invention is presented to solve the faults of conventional devices for curling eyelashes.

One object of the present invention is to provide an improved device for curling eyelashes which is able to promptly, conveniently and automatically form eyelashes into a curled shape by an application of pressure only.

Yet another object of the present invention is to provide an improved device for curling eyelashes which is able to promptly, conveniently and automatically form eyelashes into a curled shape by a simultaneous application of heat and pressure.

Another object of the present invention is to provide enhanced safety through an improved device for curling eyelashes by preventing over-heating and by automatically controlling the heating temperature of a heat generating member to a suitable temperature for curling eyelashes in a combined application of heat and pressure.

It is still a further object of the present invention to lengthen the expected life span of the batteries through a power saving feature.

A further object of the present invention is to provide an improved device for curling eyelashes which is able to indicate heater status by turning on a red light emitting diode (LED) when the power switch is turned "on" and by subsequently turning on a green LED after the heater is heated to a proper eyelash curling temperature. Also, this invention is able to alert a user to a battery power status by observing LED displays.

A further object of the present invention is to provide an eyelash curler which is simple to manufacture and easy to use.

These, and other objects of the invention are achieved by providing a device for curling eyelashes which enables prompt, convenient, and automatic formation of eyelashes into a curled shape by either a sole application of pressure or by a simultaneous application of heat and pressure. Overheating of the eyelash curler is prevented by automatically controlling the heating temperature of the heater to a suitable temperature for curling eyelashes. The device particularly includes a main body having a handle and a forwardly curved extension part on each side of the main body and sited in an upper part of the handle, the handle portion having optional batteries therein; a forming member installed on the top end of both extension parts, the forming member having an eyelash-line shape and a circular bottom with an opening longitudinally formed therein; a heating member for heating the eyelash opening part of the forming member; a pressurizing member movable up and down installed between extension parts of the main body and having a silicon pad attached to an upper part thereof, the silicon pad conforming closely to the lower part of the forming member; a rising and falling member installed on the main body for raising the pressurizing member; a power switch for controlling the heating member installed on the main body; and an indicating lamp representing the state of power installed on the main body.

Further scope of applicability of the present invention will become apparent from the detailed description given hereinafter. However, it should be understood that the detailed description and specific examples, while indicating preferred embodiments of the inventions, are given by way of illustration only since various changes and modifications within the spirit and scope of the invention will become apparent to those skilled in the art from this detailed description.

BRIEF DESCRIPTION OF THE DRAWINGS

The present invention will become more fully understood from the detailed description given herein-below and the accompanying drawings which are given by way of illustration only, and thus are not limitative of the present invention, and wherein.

DETAILED DESCRIPTION OF THE PREFERRED EMBODIMENT

Figure 1:
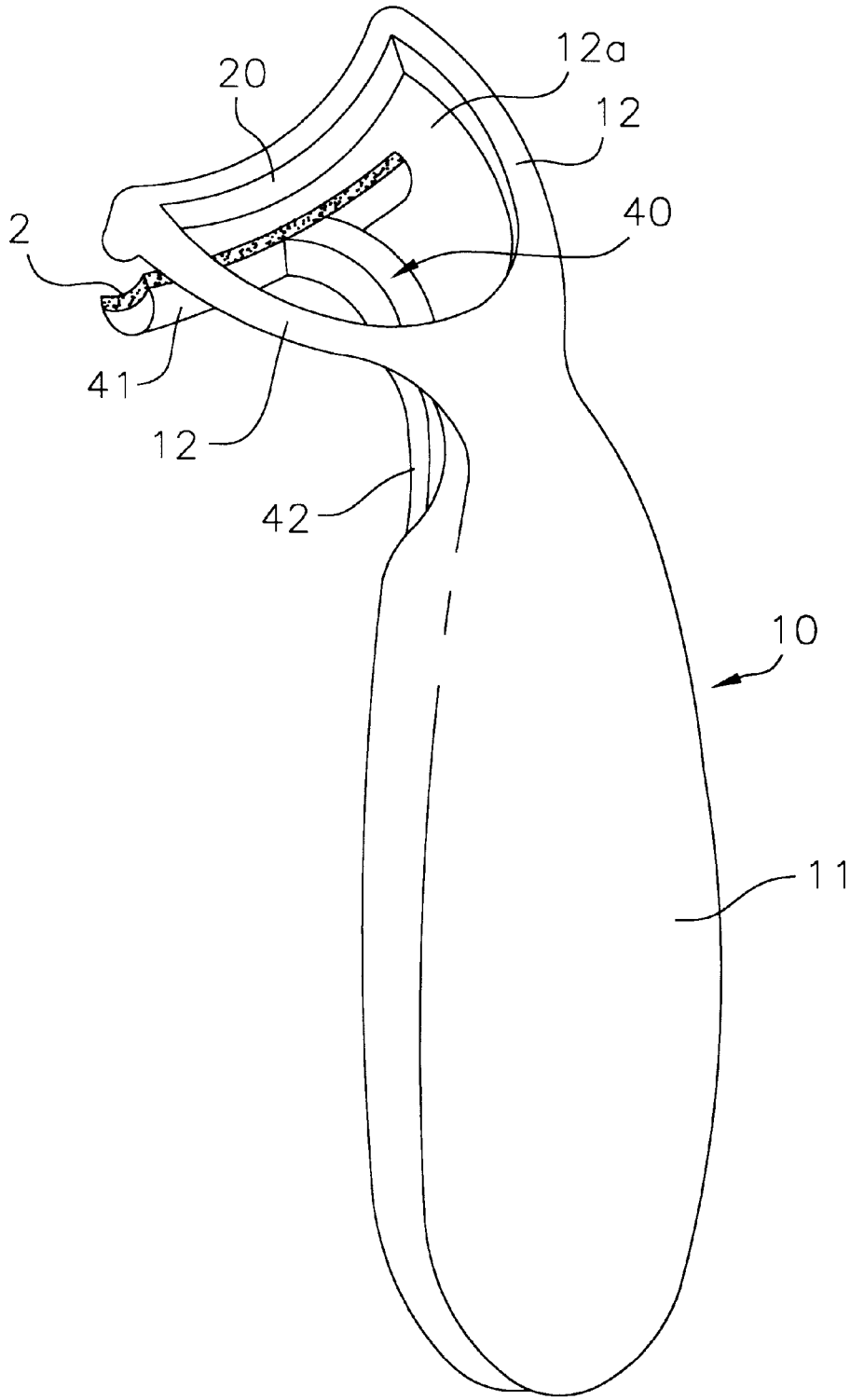
FIG. 1 is a perspective view of a device for curling eyelashes according to a first preferred embodiment of the present invention.

Referring to the drawings, a preferred embodiment of the present invention will be described in detail hereinbelow. Like parts are referred to by like reference numerals for the sake of clarity throughout the description.

As illustrated in FIGS. 1 through 3, 7 and 8, a first preferred embodiment of the present invention for curling eyelashes includes a main body 10 having a handle portion 11 and two forwardly curved extension parts 12. The two forwardly curved extension parts 12 terminate in an upper part of the handle 11 as shown and are spanned by a forming member 20.

The forming member 20 spanning the top end of the extension parts 12 conforms to the curvature of an eyelash line shape and includes a rounded eyelash contacting surface 20*a*.

A pressurizing member 40, which is movable up and down along a longitudinal axis of the handle 11, is installed between extension parts 12 of the main body 10 has a silicon pad 2 attached to the upper part thereof, the silicon pad being designed to closely conform to the lower part 20*a* of the forming member 20.

A rising and falling member 50 is installed on the main body 10 for raising the pressurizing member 40 up towards the forming member 20.

A hole 11*a* is made in an upper center of the handle 11 such that a rising and falling rod 42 of the pressurizing member 40 is able to rise or fall therethrough, and a button hole 11*b* is made in a front center of the handle 11 in order that a push button 54 may be inserted therein.

Since the two extension parts 12 are constructed of forwardly curved portions on both sides and in the upper part of the handle 11, a forming space 12*a* is formed between the extension parts 12.

A rail binding part 11*c*, to which is to bound a rail 51, and a button binding part 11*d*, to which is bound the push button 54, are respectively installed on the inside of the handle 11.

Several safety protrusions 22 are positioned at regular intervals in forward lower part of the forming member 20.

The pressurizing member 40 has a pressurizing part 41 shaped into an eyelash-shaped line and an integrally formed rising and falling rod 42. The rising and falling rod 42 is forwardly curved and inserted into the hole 11*a* in a central lower region of the pressurizing part 41. The top part of the pressurizing part 41 is formed with a curved shape, which is facing the lower part 20*a* of the forming member 20 and a silicon pad 2 is attached to the curved shape. Consequently, the top part of the silicon pad 2 is formed with a curved shape, which is facing the lower part 20*a* of the forming member 20.

The rising and falling member 50 is constructed such that the rail 51 is installed to align with the longitudinal axis of the handle 11 and a slider 53 is integrally formed with the lower part of the rising and falling rod 42 of the pressurizing member 40, such that the slider 53 rises and falls along the rail 51 against and with the elasticity of a spring 52, respectively. A push button 54 is movably installed on the front of the handle 11, and an operating lever 55, opposite ends of which are movably connected with the slider 53 and the push button 54, respectively, is movably installed within the front of the handle 11.

The rail 51 is fixedly installed inside of the handle 11 and has two tapped holes 51*a* punched therethrough, each of the holes 51*a* receiving a screw 51*b* so that the rail 51 is bound to the rail binding part 11*c*.

The slider 53 includes two rail slots 53*a* for receiving the rail 51 therein, two hinge parts 53*b* on the front of the slider 53, and a spring supporting jaw 53*c* protruding from the upper rear part of the slider 53. A lever 55 is movably connected by means of a pin 56 at the top end of the lever in the hinge parts 53*b* and a spring 52 is elastically mounted in the top end of the spring supporting jaw 53*c*.

The push button 54 includes hinge parts 54*a* which are movably assembled at both lower sides thereof and a pin slot 54*b* at an upper inside thereof. In this, the lower end of the lever 55 is movably connected in the pin slot 54*b*.

The lever 55 has a pin connecting part 55*a* for receiving a pin 56 in the upper part thereof and an integrally formed pin 55*b* parallel to the pin connecting part 55*a* and protruding beyond a width of the lever 55 at the lower end thereof. The integrally formed pin 55*b* is movably inserted into the pin slot 54*b* of the push button 54.

The invention described herein may operate in more than one way as follows. First, if the user is using the eyelash curling device with pressure alone using the device as described above in FIGS. 1 through 3, 7 and 8, and not with the additional use of heat, the following occurs.

Figure 2A:
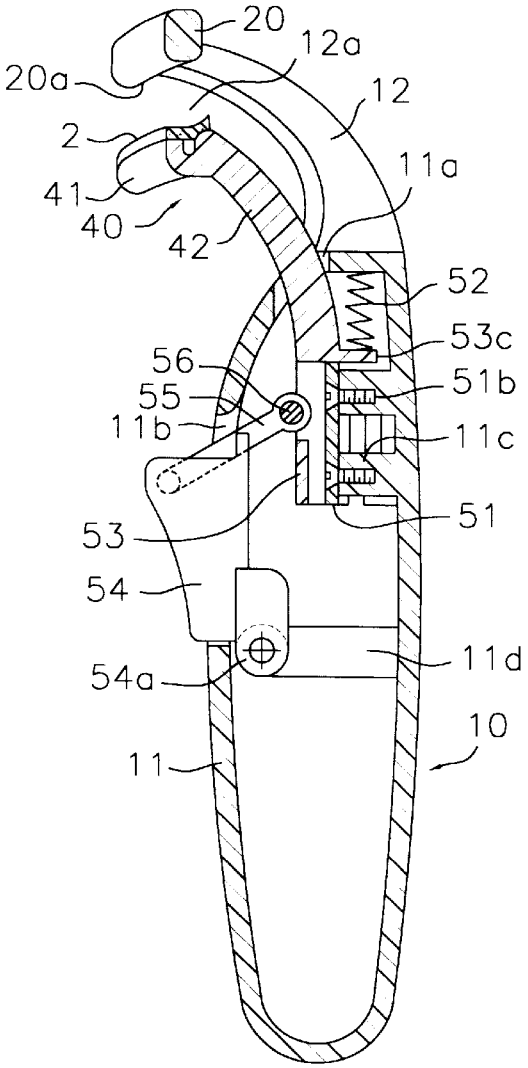
FIG. 2A is a longitudinal sectional view showing the operating state of the described invention according to the embodiment of FIG. 1 with no pressure on a pressure button.

The user holds the handle 11 with the pressurization release as shown in FIG. 2A and closely adheres and slightly pushes the forming member 20 to the upper portion of the upper eyelash so that the eyelash is positioned at the bottom part of the forming member 20 through the forming space 12*a* with the eyelash upwardly oriented.

Figure 2B:
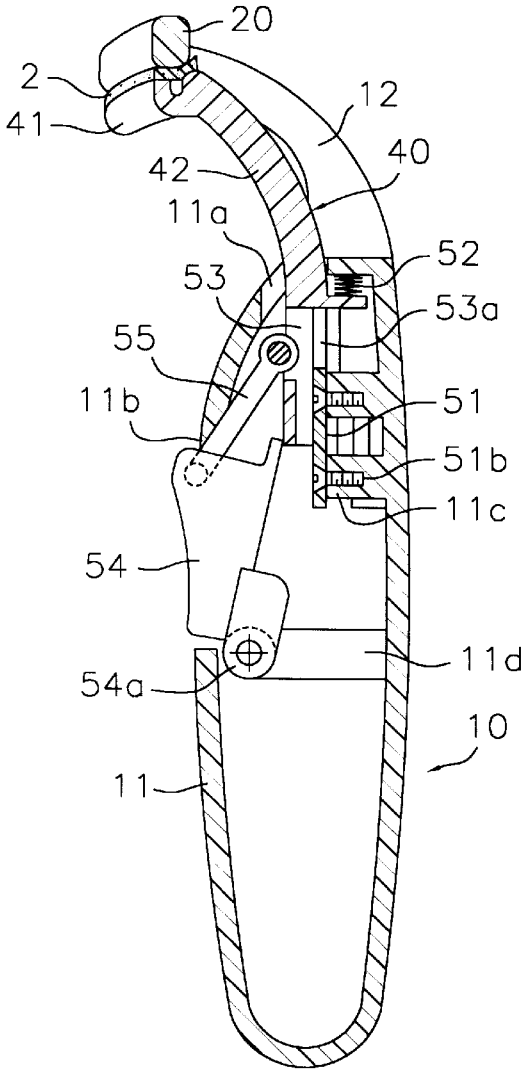
FIG. 2B is a longitudinal sectional view showing the operating state of the described invention with the pressure button depressed.
Figure 3A:
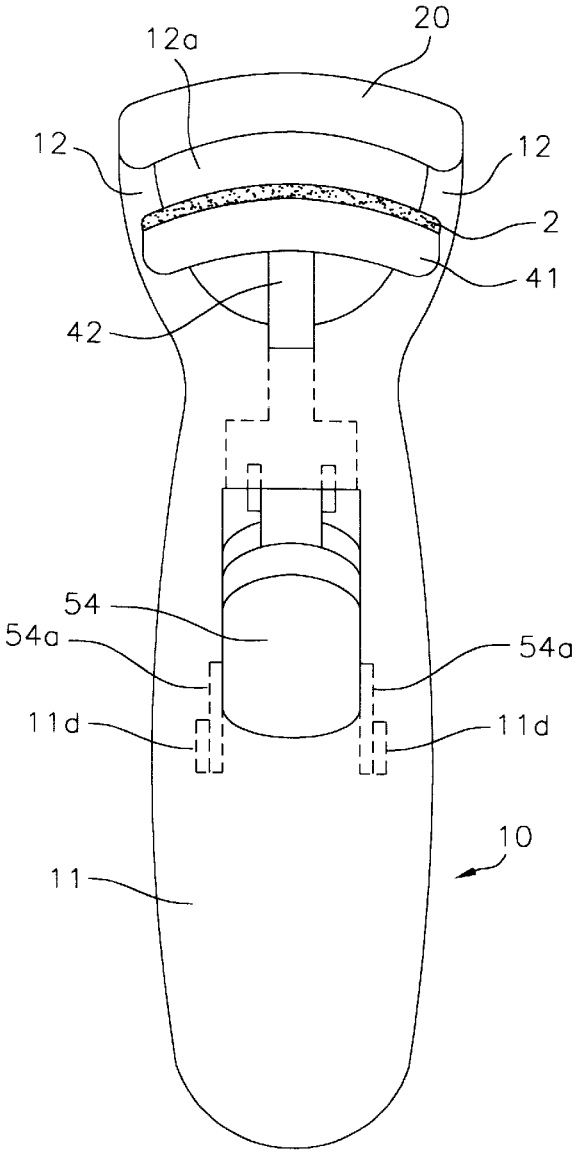
FIG. 3A is a front view and FIG. 3B is a rear view of the first embodiment of the described invention.
Figure 3B:
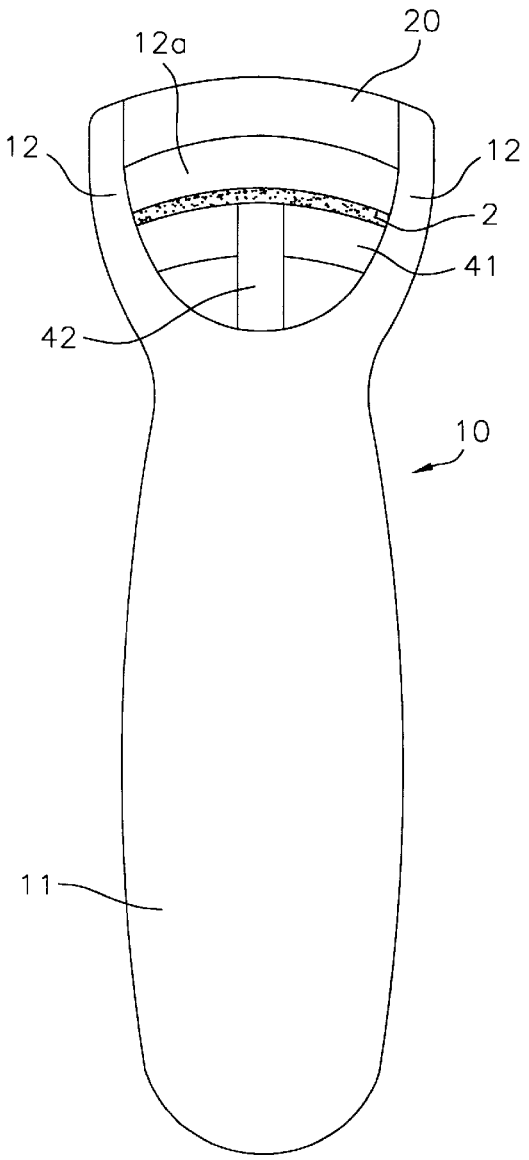
Figure 4:
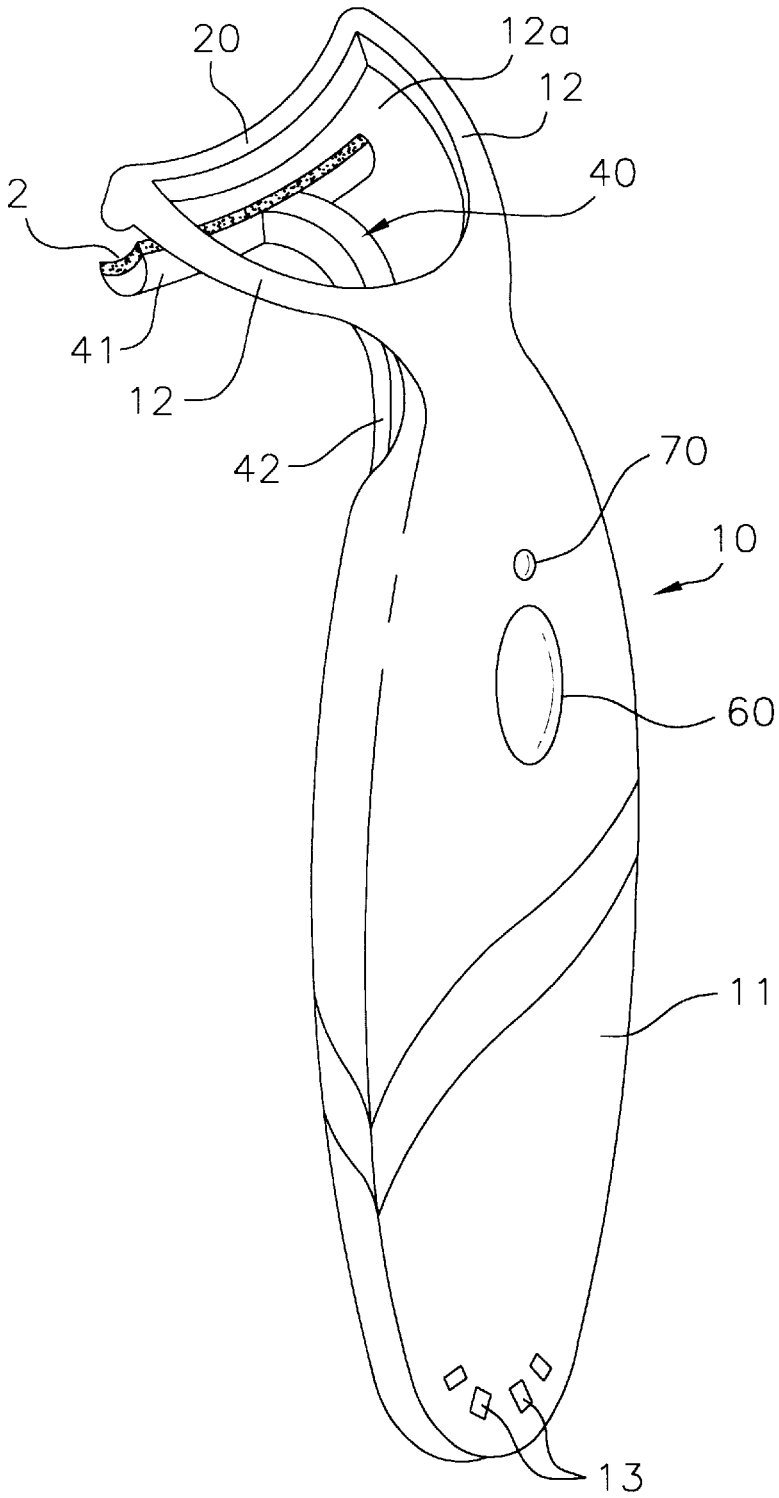
FIG. 4 is a perspective view of a device for curling eyelashes according to a second preferred embodiment of the present invention.

In this state, when the user pushes the push button 54 with her thumb as shown in FIG. 2(B), the upper part of the push button 54 moves up, centering around the hinge parts 54*a* and simultaneously with this, the lever 55 pushes the slider 53 upwardly as shown in FIG. 2(B).

Accordingly, the slider 53 is rising up along the rail 51 against a normal bias of the compressing spring 52. As a consequence of the above, the silicon pad 2 attached on the top part of the pressurizing part 41 in the pressurizing member 40 is raised and closely adhered to the bottom part of the forming member 20.

Therefore, the eyelashes sited between the top part of the pressurizing part 41 and the bottom part of the forming member 20 is naturally pressurized and curled.

In the above condition, if the user removes her thumb from the push button 54, the slider 53, the lever 55 and the push button 54 are acted on by a restoring force of the spring 52 and are returned to the condition of released pressurization as shown in FIG. 2(A). Then, the eyelash curling is complete simply by the use of pressure application alone.

In addition to the forming of eyelashes by pressure alone as described above, eyelashes can be formed into gracefully curved shape by the combined application of heat and pressure with the use of additional features found in the eyelash curler and more particularly shown in the embodiment of FIGS. 4 through 11.

Specifically, the handle portion 11 of the main body 10 houses batteries 1 therein. A power switch 60 is provided on an external surface of the handle 11 for controlling the heating member 30 installed on the main body 10, and an indicator lamp 70 illuminates external to the handle 11 for representing the state of power of the eyelash curling device.

The handle 11 of the main body 10 has charging terminals 13 for charging batteries 1 of the device with electricity by conduction with a battery charger 3. A battery cover concealed as a part of the handle portion 11 enables installation and removal of batteries 1 from the handle portion 11 of the device. More specifically, the handle portion 11 itself serves as the battery cover such that the handle is in two parts, front and back (not shown) that snaps together to cover the inside parts of the curler. Also, the inside of the handle 11 includes two general battery holders 14 for supporting the batteries 1 and conducting electricity. Both general non-rechargeable batteries and rechargeable storage batteries can be used for powering the device and curling eyelashes in this invention. However, rechargeable storage batteries should be used in case of charging.

The heating member 30 has a heater 32 which is installed in a teflon coated bronze pipe 31.

The batteries 1, the heater 32, the power switch 60, and the indicating lamp 70 are reciprocally electrically connected through a control circuit. When the power switch 60 is turned "on", the indicating lamp 70 is illuminated by a red LED and then after the heater 32 is heated to a proper temperature for use, approximately 60–68° C., the indicating lamp 70 is illuminated by a green LED. That is, the presence of the green LED of the indicating lamp 70 after turning the power switch 60 on means that the heater 32 is heated to proper temperature for curling eyelashes. Accordingly, at that time, a user can curl her eyelashes.

Thus, in addition to the forming of eyelashes by pressure alone as described above, eyelashes can be formed into gracefully curved shape by the combined application of heat and pressure if the heater 32 of the heated element 30 sited in the lower part of the forming member 20 is actuated to the predetermined proper temperature and the pressurizing part 41 with the silicon pad 2 is facing the heated forming member 20. Accordingly, in the event that the user wishes to utilize the eyelash curler with both the application of heat and pressure, the following occurs.

Figure 5A:
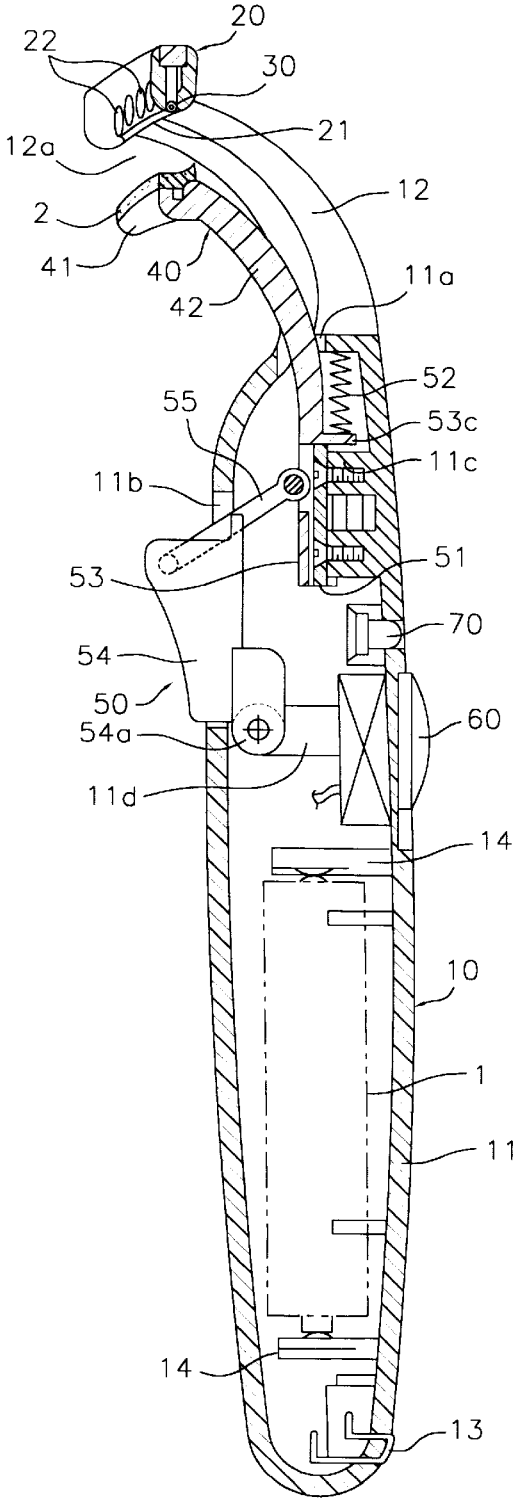
FIG. 5A is a longitudinal sectional view showing the operating state of the described invention according to FIG. 4 with no pressure on a pressure button.

When the indicating lamp 70 is illuminated after turning the power switch on, a user holds the handle 11 with pressurization released as shown in FIG. 5(A) and closely adheres and slightly pushes the forming member 20 to the upper portion of the upper eyelash so that the eyelash is positioned at the bottom part of the forming member 20 through the forming space 12*a* with the eyelash upwardly oriented.

Figure 5B:
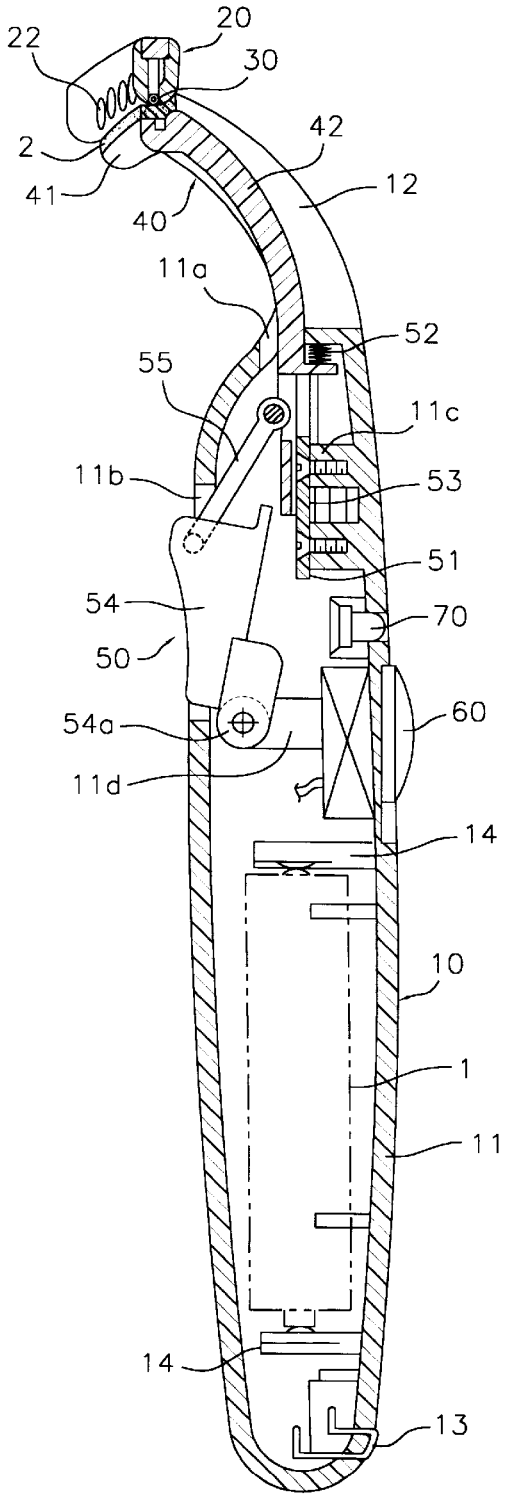
FIG. 5B is a longitudinal sectional view showing the operating state of the described invention according to FIG. 4 with the pressure button depressed.
Figure 6A:
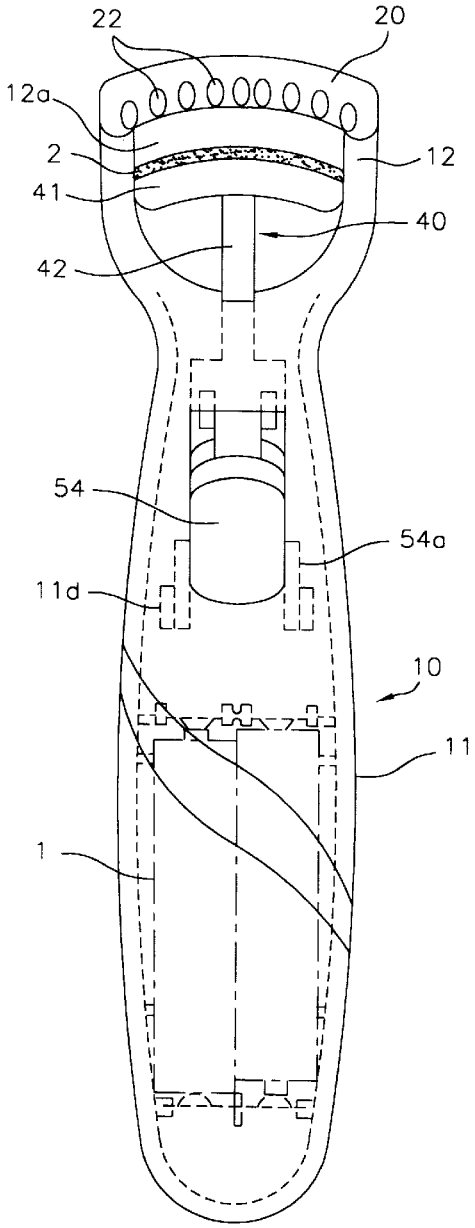
FIG. 6A is a front view and FIG. 6B is a rear view of the second embodiment of the described invention.
Figure 6B:
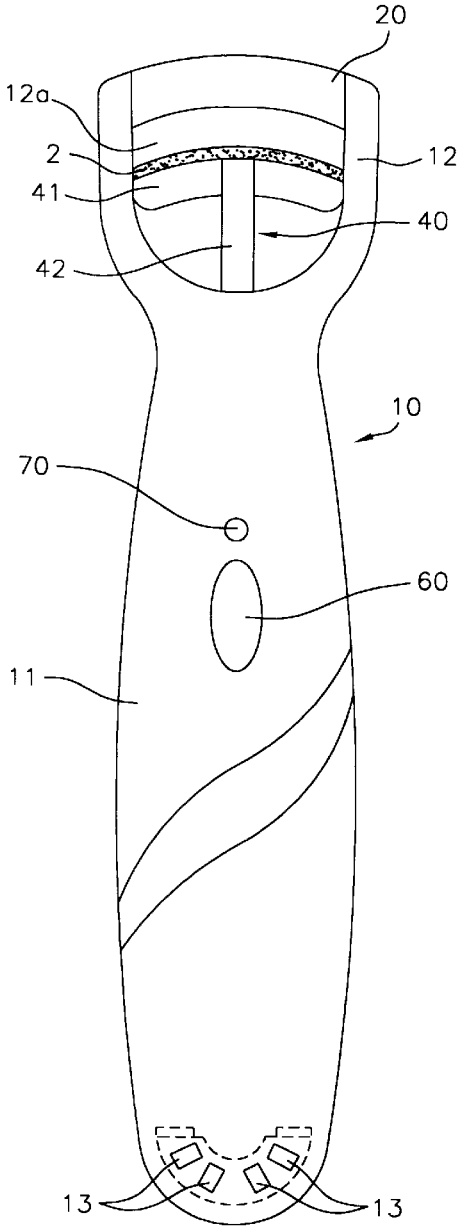
Figure 7A:
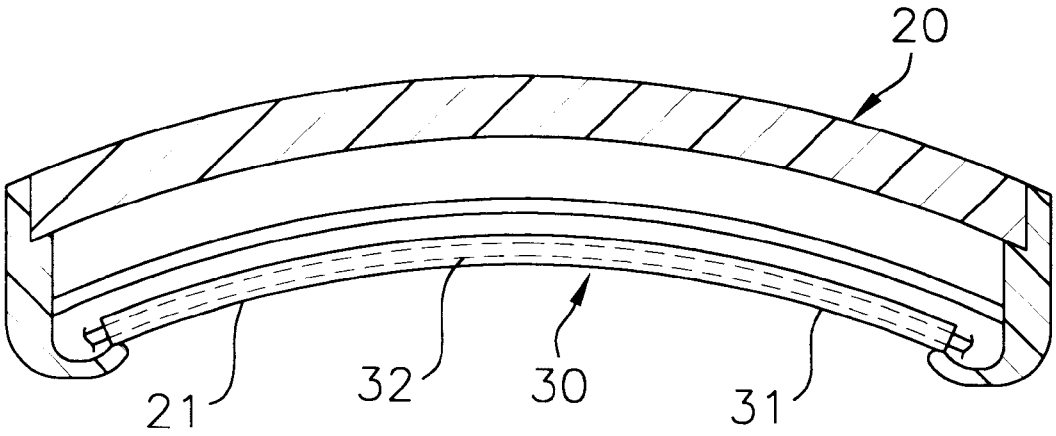
FIG. 7A is a sectional view and FIG. 7B is a longitudinal sectional view of a forming part extracted from the device for curling eyelashes according to this invention.
Figure 7B:
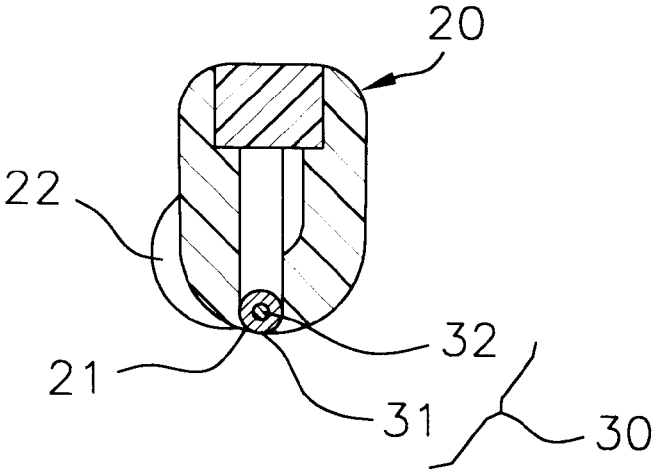
Figure 8:
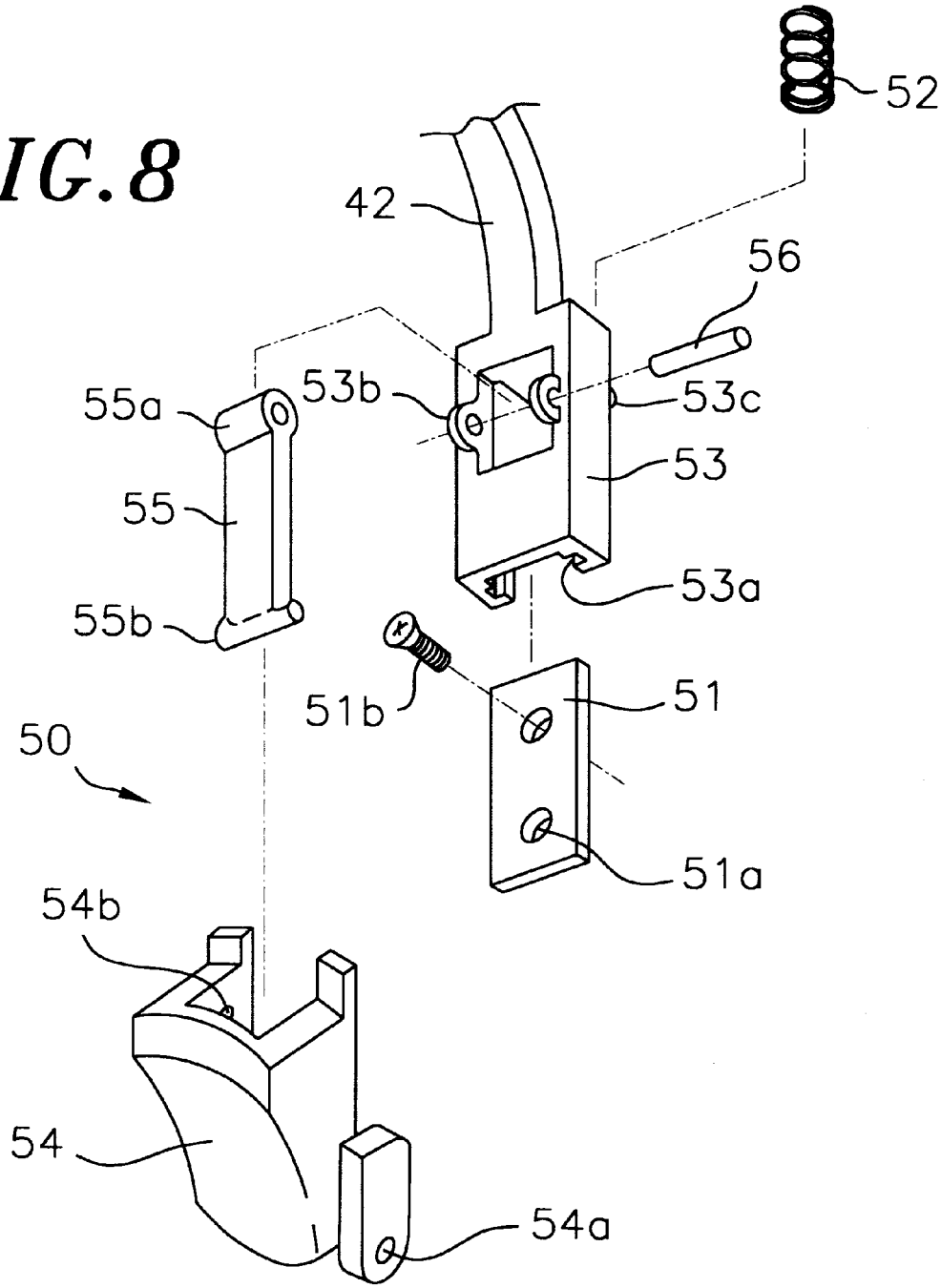
FIG. 8 is a partially exploded perspective view of a rising and falling member for use with either of the first or second embodiments of the present invention.

In this state, when the user pushes the push button 54 with her thumb as shown in FIG. 5(B), the upper part of the push button 54 moves up, centering around the hinge parts 54*a* and simultaneously with this, the lever 55 pushes the slider 53 upwardly as shown in FIG. 5(B).

Accordingly, the slider 53 is rising up along the rail 51 against a normal bias of the compressing spring 52. As a consequence of the above, the silicon pad 2 attached on the top part of the pressurizing part 41 in the pressurizing member 40 is raised and closely adhered to the bottom part of the forming member 20.

Therefore, the eyelashes sited between the top part of the pressurizing part 41 and the bottom part of the forming member 20 is naturally pressurized and curled.

In the above condition, if the user removes her thumb from the push button 54, the slider 53, the lever 55 and the push button 54 are acted on by a restoring force of the spring 52 and are returned to the condition of released pressurization as shown in FIG. 5(A). Then, the eyelash curling is complete and the power switch is turned off.

Figure 10:
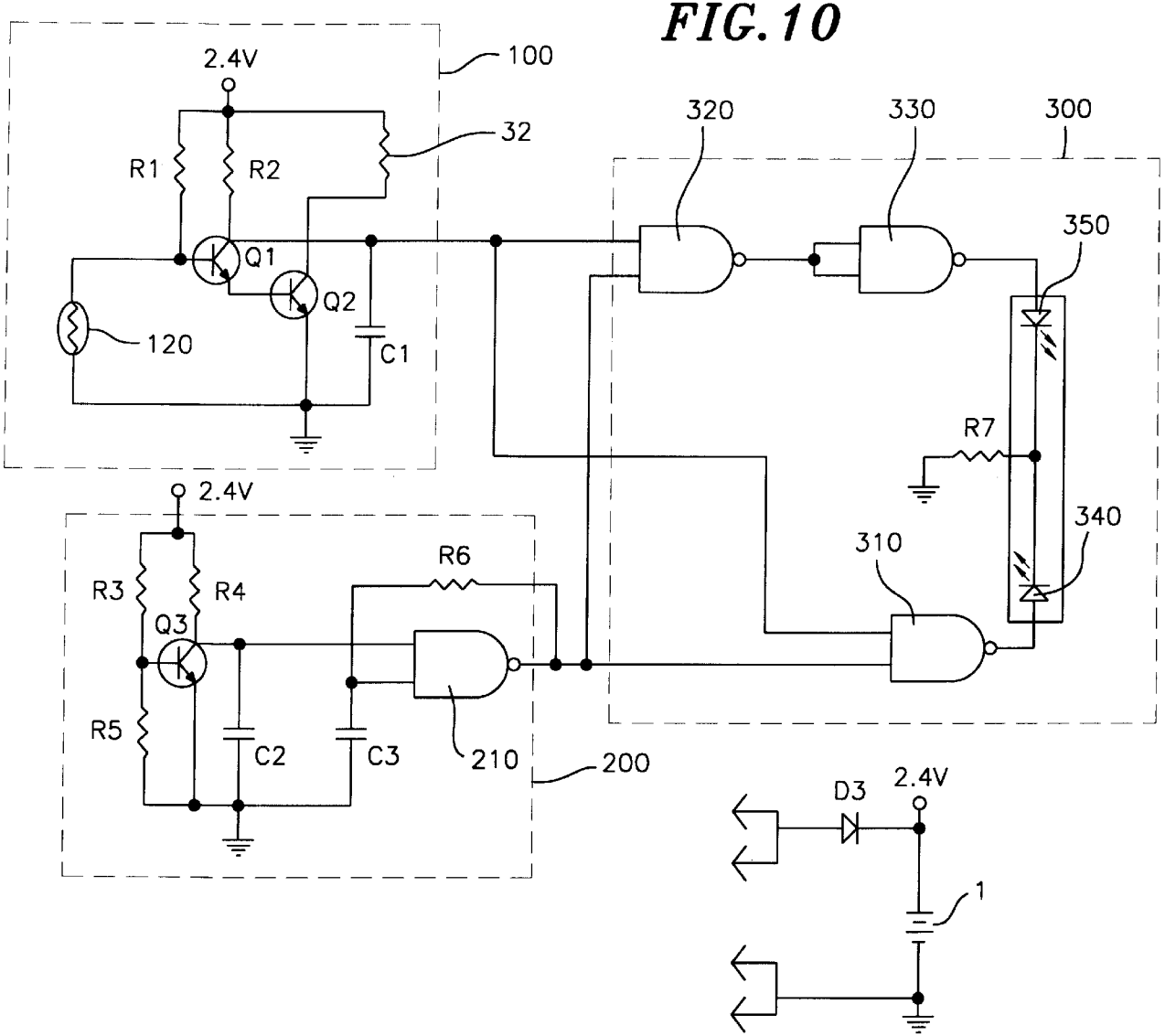
FIG. 10 is a circuit diagram of an indicating part for indicating heater status and battery charge state of the device for curling eyelashes according to this invention.
Figure 11:
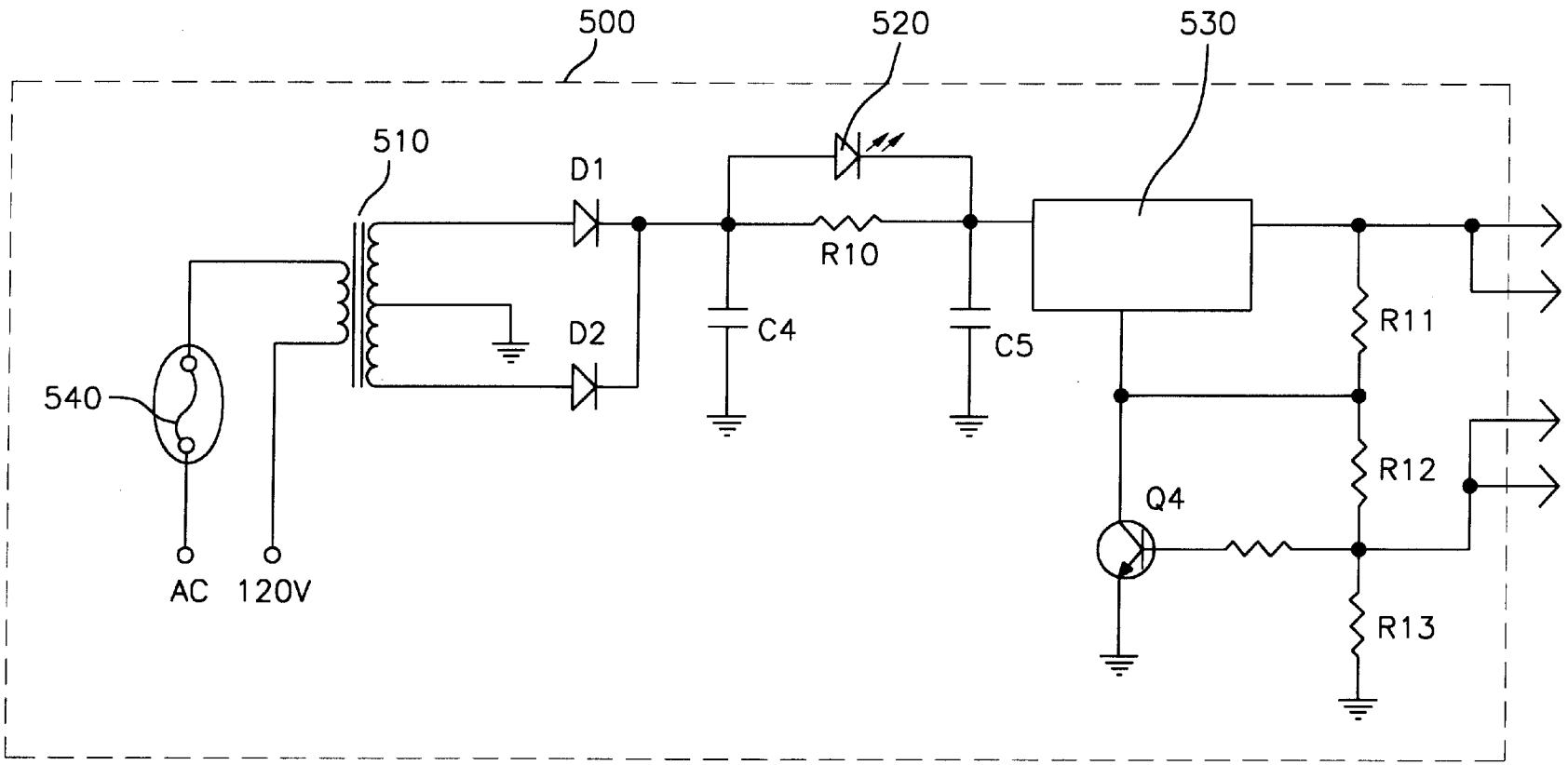
FIG. 11 is a detailed view of a charger member for charging rechargeable batteries using an external power source.

Turning now to FIG. 10 and FIG. 11, there is illustrated the apparatus for indicating the heater status and charged condition in the device of the present invention as constructed above for use with both the application of heat and pressure.

The apparatus for indicating heater status and charged condition of the device for curling eyelashes of this invention includes a temperature control portion for heating the heater by the power supply output from batteries and for limiting the amount of the electric current sent to the heater so as to maintain a constant the temperature of the heater; a sensor for checking a usable power remaining in the batteries; and an indicating portion for logically calculating signals respectively output from the temperature control portion and the sensor and then optically representing the heater status and the charged condition of the batteries using the result of the calculation.

Also, the device for curling eyelashes of the described invention further includes a charging member when a rechargeable battery instead of a general battery is used. The charging member charges the batteries by rectifying an external alternating current (AC) power supply.

Hereafter, a preferred embodiment of this invention in accordance with the technical thought described above is illustrated on the basis of the figures.

FIG. 10 is directed to a circuit diagram representing the heater temperature status of the device for curling eyelashes and a charge condition of the batteries.

As shown in FIG. 10, the circuit diagram for indicating heater status and battery charge condition of this invention includes a temperature control portion 100 for heating the heater by the voltage (+2.4 V) output from the batteries 1, which is a means for supplying a power source and limiting the amount of electric current sent to the heater 32 so as to maintain a constant temperature of the heater 32; a battery sensitive part 200 for checking usable power remaining in the batteries 1; and an indicating portion 300 for logically calculating signals respectively output from the temperature control portion 100 and the sensor and then optically representing the heater temperature status and charge condition of the batteries 1 using the result of the calculation.

The temperature control portion 100 includes a first transistor (Q1) for switching voltage output from the batteries 1; a second transistor (Q2) for controlling an amount of current flowing to the heater 32 by the emitter terminal output of the first transistor (Q1); and a thermistor 120 for controlling a base voltage of the first transistor (Q1) by changing internal resistivity depending on the heating temperature of the heater 32.

The battery sensitive part 200 includes first and second resistance (R3), (R5) dividing a discharge voltage of the batteries 1; a third transistor (Q3) switching according to the voltage divided into the first and the second resistance (R3) (R5); and a NAND gate 210 logically operating the output signal of the third transistor (Q3) and the feedback output of itself.

Also, the indicating portion 300 includes a first NAND gate 310 logically operating the output from the temperature control portion 100 and the output signal from the battery sensitive part 200 and then outputting a result as a control signal which represents a heated condition of the heater 32 and a charged condition of the batteries 1. A red light emitting diode 340 represents a situation where emitted light is limited by the output signal of the first NAND gate 310. A second NAND gate 320 logically operates the output of the temperature control portion 100 and the output signal from the battery sensitive part 200 and then outputs a result as a control signal. A third NAND gate 330 receives the output from the second NAND gate 320 through two input ends, logically operates the input and then outputs the result. A green LED 350 optically represents a proper heater temperature and battery status of the device for curling eyelashes in accordance with the light emitted by the output signal of the third NAND gate 330. In this case, the red LED 340 and green LED 350 are installed inside of the indicator lamp 70.

An indicating apparatus for representing heater temperature status and charge condition of the device for curling eyelashes of the present invention constructed above is operated as follows.

In FIG. 11, when a user turns "on" the power switch 60 in the eyelash curler unit, the first and second resistance (R3), (R5) in the battery sensitive part 200 divide the voltage and apply it to a base end of the third transistor (Q3).

Then, the third transistor (Q3) is operated in an "on" or "off" condition by the voltage applied to the base end. At this point, if the batteries 1 are in an adequately charged state, the third transistor (Q3) becomes turned on and the output of the collector end becomes low.

In addition, when the power switch 60 is turned on, the first transistor (Q1) in the temperature control portion 100 becomes turned on whereby the second transistor (Q2) connected with the emitter end also becomes turned on so as to supply heating voltage to the heater 32 for heating.

Further, when the first transistor (Q1) is turned on, the output of the collector end thereof becomes low.

In the above state, the first NAND gate 310 in the indicating part 300 for representing heater status and charge condition, illuminates a red LED 340 since the batteries 1 are in a charged state and the output of the temperature control portion 100 is low.

As described above, when the red LED 340 is illuminated, a user recognizes that a power supply of the batteries 1 is sufficient but that the heater 32 is not yet heated to a proper temperature for use.

When the heater 32 is heated in the above state, the thermistor 120 checks the heating temperature thereof. That is, the thermistor 120 can check the heating temperature by the fact that the resistivity of the internal resistor is changed in accordance with changes of external temperature.

When the heater 32 is gradually heated as time goes by and the temperature becomes usable at, for example, 60° C.–80° C., the resistivity of the internal resistor is so increased that the turn on amount of the first transistor (Q1) becomes very small.

When the input amount of the transistor (Q1) becomes very small, the input amount of the second transistor (Q2) also becomes very small relative thereto.

At this moment, the output of the first transistor (Q1) becomes high and thereby the output of the first NAND gate 310 in the indicating portion 300 becomes low, and accordingly, the red LED 340 is turned off.

The output of the second NAND gate 320 in the indicating portion 300 becomes low because both input ends are high, and the output of the third NAND gate 330 becomes a high signal by the low signal output from the second NAND gate 320.

By means of this high signal, the green LED 350 becomes illuminated so as to inform a user that the heater has been heated to a properly usable temperature. Then, the user may use the device of this invention for curling eyelashes.

On the other hand, if the batteries 1 are discharged and become below the setting voltage (1.1 V) while a user is using the device of this invention for curling eyelashes after confirming the illumination of the green LED 350, the third transistor (Q3) in the battery sensitive part 200 turns off.

Accordingly, the output of the NAND gate 210 becomes low and thereby the output of the first NAND gate 310 in the indicating part for heater status and charge condition 300 becomes high. Therefore, the red LED 340 becomes illuminated.

In this case, the NAND gate 210 in the battery sensitive part 200 will feedback its output so as to use it as an input again. So, the output of the NAND gate 210 rapidly repeats a low and high signal.

Accordingly, the output of the first NAND gate 310 in the indicating part for heater status and charge condition 300 also rapidly repeats low and high in order to correspond to the above.

By these operations, the device of this invention for curling eyelashes informs a user of the low-charged state of the batteries 1 by the red and green LED's rapidly turning-on and off repeatedly.

If the batteries in place are non-rechargeable general batteries, the user replaces the batteries 1 with new ones after confirming the above illumination effect.

Figure 9:
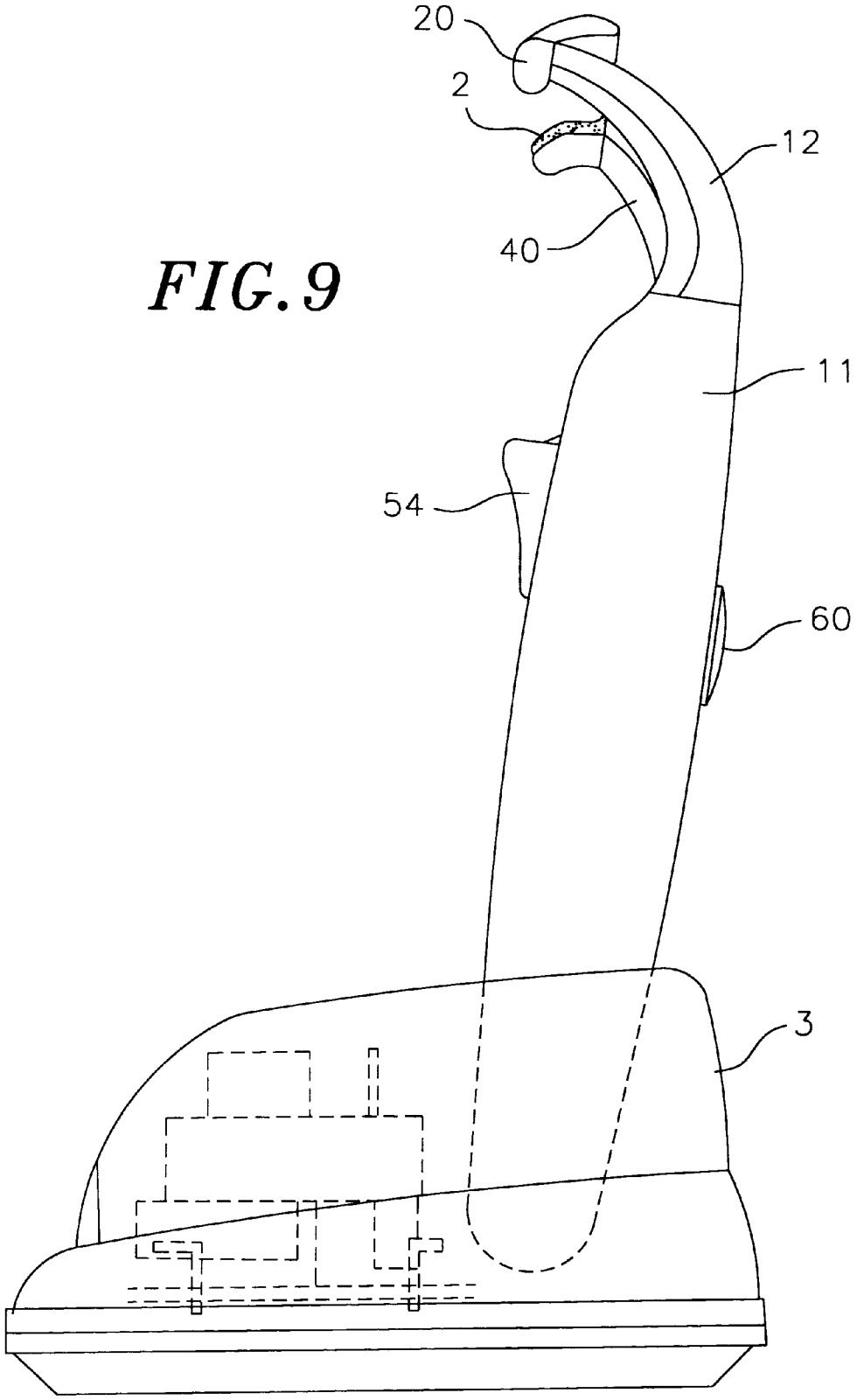
FIG. 9 is a preferred embodiment showing a device for curling eyelashes according to this invention inserted into a battery charger.

When replacing with non-rechargeable general batteries, it is possible to immediately use the device, but in the case where the batteries 1 are rechargeable storage batteries, the user must electrically charge the rechargeable batteries using the battery charger 3 as shown in FIG. 9 and FIG. 11. Hereafter, the battery charger 3 will be more particularly described.

FIG. 11 is a detailed circuit diagram of the charging portion of the battery charger used in this invention.

As shown in FIG. 11, the circuit diagram of the battery charger 3 includes a fuse 540 for interrupting the input of power supply and thereby protecting the rear circuit and at the same time being cut off if the temperature of a transformer 510 is over 120° C. from the viewpoint of safety standard in case of an instantaneous over current flowing on the input AC power supply (AC 120 V or AC 220 V). The transformer 510 reduces the input AC power supply to a predetermined level through the fuse 540. A first current diode (D1) rectifies AC power supply during a plus (+) half-period output from the second side of the transformer 510 to a half wave. A second current diode (D2) rectifies AC power supply during a minus (−) half-period output from the second side of the transformer 510 to a half-wave. A smoothing condenser (C4) smooths direct-current power supply passed by the first and the second rectification diodes (D1), (D2). A light emitting diode 520 represents that charging is on by emitting the power supply through the smoothing condenser (C4). A constant-voltage generator 530 makes the direct-current power supply passed by the smoothing condenser (C4) into a constant voltage and then supplies it to the batteries 1 as voltage for charging. Several resistances (R11–R13) and a transistor (Q4) are provided for detecting the charged state of the batteries 1 and transmitting an output thereof to the constant-voltage generator 530.

The operation in the charging part 500 of the present invention constructed as described above is as follows.

First, input AC power supply is reduced at the transformer 510 and then is output through the second side thereof. The first and second current diodes (D1), (D2) make the AC power rectify during the plus half-period and the minus half-period to direct-current voltage.

On the other hand, the constant-voltage generator 530 makes the power supply passed by the transistor (C4) constant voltage or constant current of a predetermined level and thereby gives a charge of electricity to the batteries 1.

In this charging part 500, the several resistances (R11–R13) and the transistor (Q4) play the role of detecting a charged state of the batteries 1.

Thus described, the device of this invention for curling eyelashes is very useful to promptly, conveniently and automatically form eyelashes into a curled shape by means of simultaneously using heat and pressure, or by pressure alone, thereby curling eyelashes safely and gracefully by even non-proficient users. The device is further able to prevent over-heating and to enhance safety by automatically controlling the heating temperature of the heat-generating body to a suitable temperature for curling eyelashes and also to lengthen the expected life span of batteries with a power saving feature.

Also, the described invention has an effect to provide a benefit to users by detecting the heating temperature of the heater and informing the user of a heater status through the light emitting diodes.

Further, the described invention has another effect to optically inform users of the charge condition of batteries by turning a red light emitting diode on and off when the batteries are low.

It is a further advantage to prevent a failed curl of the eyelashes with only a slight heat or from being damaged by overheating since the heater temperature status is represented when the heater of the device for curling eyelashes is heated to a usable temperature.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for curling eyelashes comprising:

a main body having a handle portion and a forwardly curved extension part on each side of the main body and sited in an upper part of said handle portion, said handle portion having batteries therein;

a forming member installed at terminating ends of said extension parts, said forming member having an eyelash-line shape and a circular bottom including an opening part longitudinally formed therein;

a heating member for heating the eyelash opening part of said forming member;

a pressurizing member movable up and down installed between extension parts of said main body and having a silicon pad attached to an upper part thereof, said silicon pad conforming closely to the lower part of said forming member;

a rising and falling member installed on said main body for raising said pressurizing member;

a power switch for controlling said heating member installed on said main body; and an indicating lamp representing state of power installed in said main body, wherein the handle of said main body has charging terminals for charging batteries with electricity by conduction with a battery charger.

2. The device for curling eyelashes according to claim 1, wherein a plurality of safety protrusions are positioned at regular intervals in a forward lower part of said forming member.

3. The device for curling eyelashes according to claim 1, wherein said heating member has a heater which is installed in a bronze pipe coated with teflon, said heater including a temperature control portion for heating the heater by the voltage output from a battery power source and for limiting the amount of electric current sent to the heater so as to maintain a constant temperature of the heater;

a battery sensitive part for checking adequacy of said batteries; and an indicating portion for logically calculating signals respectively output from said temperature control portion and said sensor and then optically representing the heater status and charge condition of said battery power source using the result of said calculation.

4. The device for curling eyelashes according to claim 1, wherein said rising and falling member includes:

a rail installed on said handle portion;

a slider formed with one body in a lower part of a rising and falling rod of said pressurizing member, said slider perpendicularly rising and falling along said rail according to elasticity of a spring;

a push button movably installed on a front of said handle; and an operating lever, both ends of which are movably connected with said slider and said push button.

5. A device for curling eyelashes according to claim 1, further comprising a circuit for indicating heater status and charge condition of said device, said circuit comprising:

a temperature control portion for heating said heater by the voltage output from said battery power supply and for limiting the amount of the electric current sent to said heater so as to constantly maintain the temperature of said heater;

a battery sensitive part for checking an adequacy of said battery power source; and an indicating portion for logically calculating signals respectively output from said temperature control portion and said sensor and then optically representing said heater status and charge condition of said battery power supply using the result of said calculation.

6. The device for curling eyelashes according to claim 3, wherein said temperature control portion includes:

a first transistor for switching voltage output from said battery power source;

a second transistor for controlling the amount of current flowing to the heater by the emitter terminal output of said first transistor; and a thermistor controlling a base voltage of said first transistor by changing internal resistivity depending on a temperature of said heater.

7. The device for curling eyelashes according to claim 3, wherein said battery sensitive part includes:

first and second resistance for dividing discharge voltage of said batteries;

a third transistor for switching the voltage divided into said first and the second resistance; and a NAND gate logically operating an output signal of said transistor and a feedback output of itself thereby outputting results as a value detecting a condition of said battery power source.

8. The device for curling eyelashes according to claim 1, wherein said indicating lamp is controlled by an indicating portion, said indicating portion includes:

a first NAND gate logically operating the output from said temperature control portion and the output signal from said battery sensitive part and then outputting above result as a control signal which represents a heated condition of the heater and charge condition of said battery power source;

a red light emitting diode representing the heater status and charge condition of said battery power source whereby light emitted is limited by the output signal of said first NAND gate;

a second NAND gate logically operating the output of said temperature control portion and the output signal from said battery sensitive part and then outputting a result as a control signal;

a third NAND gate receiving the output from said second NAND gate which has two input ends, logically operating it and then outputting the result; and a green light emitting diode optically representing proper heater temperature of said device for curling eyelashes in accordance with light emitted by the output signal of said third NAND gate.

9. The device for curling eyelashes according to claim 3, further including a charging part which charges said battery power source by rectifying an external alternating current power supply.

10. A device for curling eyelashes comprising:

a main body having a handle portion and a forwardly curved extension part on each side of said main body and sited in an upper part of said handle portion, said forwardly curved extension parts being offset to a common side of a longitudinal axis of said handle portion;

a forming member installed at terminating ends of said extension parts, said forming member having an eyelash-line shape and a circular bottom including an opening part longitudinally formed therein;

a pressurizing member movable up and down installed between extension parts of said main body and having a silicon pad attached to an upper part thereof, said silicon pad conforming closely to the lower part of said forming member;

a rising and falling member installed on said main body and within outer dimensions of said forwardly curved extension parts for raising and said pressurizing member up, said rising and falling member including a rail member parallel to said handle, a slider, and a push button operating lever.

11. The device for curling eyelashes according to claim 10, wherein a plurality of safety protrusions are positioned at regular intervals in a forward lower part of said forming member.

12. The device for curling eyelashes according to claim 10, wherein said rising and falling member includes:

a rail installed on said handle portion;

a slider formed with one body in a lower part of a rising and falling rod of said pressurizing member, said slider perpendicularly rising and falling along said rail according to elasticity of a spring;

a push button movably installed on a front of said handle; and an operating lever, both ends of which are movably connected with said slider and said push button.

13. A device for curling eyelashes comprising:

a main body having a handle portion and a forwardly curved extension part on each slide of said main body and sited an upper part of said handle portion, said forwardly curved extension parts being offset to a common side of a longitudinal axis of said handle portion, and said handle portion having batteries therein;

a forming member installed at terminating ends of said extension parts, said forming member having an eyelash-line shape and a circular bottom including an opening part longitudinally formed therein;

a heating member for heating the eyelash opening part of said forming member, said heating member having a temperature control, a power source, and means for limiting an amount of current sent form said power source to said heating member;

a pressurizing member movable up and down and installed between extension parts of said main body and having a silicon pad attached to an upper part thereof, said silicon pad conforming closely to the lower part of said forming member;

a rising and falling member installed on said main body and within outer dimensions of said forwardly curved extension parts for railing said pressurizing member;

a power switch installed on said main body for controlling said heating member; and an indicating lamp installed on said main body and responsive to the state of power of said power supply.

14. The device for curling eyelashes according to claim 13, wherein a plurality of safety protrusions are positioned at regular intervals in a forward lower part of said forming member.

15. The device for curling eyelashes according to claim 13, wherein said heating member has a heater which is installed in a bronze pipe coated with teflon, said heater including a temperature control portion for heating the heater by the voltage output from a battery power source and for limiting the amount of electric current sent to the heater so as to maintain a constant temperature of the heater;

a battery sensitive part for checking adequacy of said batteries; and an indicating portion for logically calculating signals respectively output from said temperature control portion and said sensor and then optically representing the heater status and charge condition of said battery power source using the result of said calculation.

16. The device for curling eyelashes according to claim 13, wherein said rising and falling member includes:

a rail installed on said handle portion;

a slider formed with one body in a lower part of a rising and falling rod of said pressurizing member, said slider perpendicularly rising and falling along said rail according to elasticity of a spring;

a push button movably installed on a front of said handle; and an operating lever, both ends of which are movably connected with said slider and said push button.

17. A device for curling eyelashes according to claim 13, further comprising a circuit diagram for indicating heater status and charge condition of said device, said circuit comprising:

a temperature control portion for heating said heater by the voltage output from said battery power supply and for limiting the amount of the electric current sent to said heater so as to constantly keep the temperature of said heater;

a battery sensitive part for checking an adequacy of said battery power source; and an indicating portion for logically calculating signals respectively output from said temperature control portion and said sensor and then optically representing said heater status and charge condition of said battery power supply using the result of said calculation.

18. The device for curling eyelashes according to claim 15, wherein said temperature control portion includes:

a first transistor for switching voltage output from said battery power source;

a second transistor for controlling the amount of current flowing to the heater by the emitter terminal output of said first transistor; and a thermistor controlling a base voltage of said first transistor by changing internal resistivity depending on a temperature of said heater.

19. The device for curling eyelashes according to claim 15, wherein said battery sensitive part includes:

first and second resistance for dividing discharge voltage of said batteries;

a third transistor for switching the voltage divided into said first and the second resistance; and a NAND gate logically operating an output signal of said transistor and a feedback output of itself thereby outputting results as a value detecting a condition of said battery power source.

20. The device for curling eyelashes according to claim 13, wherein said indicating lamp is controlled by an indicating portion, said indicating portion includes:

a first NAND gate logically operating the output from said temperature control portion and the output signal from said battery sensitive part and then outputting above result as a control signal which represents a heated condition of the heater and charge condition of said battery power source;

a red light emitting diode representing the heater status and charge condition of said battery power source whereby light emitted is limited by the output signal of said first NAND gate;

a second NAND gate logically operating the output of said temperature control portion and the output signal from said battery sensitive part and then outputting a result as a control signal;

a third NAND gate receiving the output from said second NAND gate which has two input ends, logically operating it and then outputting the result; and a green light emitting diode optically representing proper heater temperature of said device for curling eyelashes in accordance with light emitted by the output signal of said third NAND gate.

* * * * *